United States Patent [19]

Hodges

[11] 4,360,994

[45] Nov. 30, 1982

[54] CONCRETE CRACK SEALING SYSTEM

[76] Inventor: Bonnie E. Hodges, 761 Palmer Dr., Greenville, Mich. 48838

[21] Appl. No.: 211,574

[22] Filed: Dec. 1, 1980

[51] Int. Cl.[3] ..... E04G 23/02

[52] U.S. Cl. ..... 52/744; 264/36

[58] Field of Search ..... 52/744, 514, 743; 264/35, 36

[56] References Cited

U.S. PATENT DOCUMENTS

| | | | |
|---|---|---|---|
| 1,814,127 | 7/1931 | Christians | 52/744 |
| 1,883,196 | 10/1932 | Wertz | 264/36 |
| 1,953,452 | 4/1934 | Wertz | 264/36 |
| 2,074,566 | 3/1937 | Sheils | 52/744 |
| 2,214,219 | 9/1940 | Barrett | 52/744 |
| 2,313,110 | 3/1943 | Wertz | 264/36 |
| 3,224,346 | 12/1965 | Simonson et al. . | |
| 3,492,827 | 2/1970 | Stevens | 264/36 X |
| 3,593,799 | 7/1971 | Boughton | 264/36 X |
| 3,646,720 | 3/1972 | Watts | 52/744 |
| 3,709,711 | 1/1973 | Holmstrom | 264/36 |
| 3,776,525 | 12/1973 | Warner . | |
| 3,894,131 | 7/1975 | Speech . | |
| 3,900,999 | 8/1975 | Callan | 52/744 |
| 4,012,822 | 3/1977 | Vrolyk et al. | 264/36 X |
| 4,060,953 | 12/1977 | Milne | 264/36 X |
| 4,086,309 | 4/1978 | Alberts | 264/36 X |
| 4,103,498 | 8/1978 | Steinborn et al. | 52/744 X |
| 4,139,592 | 2/1979 | Gallizia | 264/36 |
| 4,269,014 | 5/1981 | Grammerstorf | 52/744 X |

FOREIGN PATENT DOCUMENTS

| | | | |
|---|---|---|---|
| 1280540 | 10/1968 | Fed. Rep. of Germany | 52/744 |
| 2057399 | 5/1971 | France | 264/36 |
| 821535 | 10/1959 | United Kingdom | 264/36 |

*Primary Examiner*—J. Karl Bell

*Attorney, Agent, or Firm*—Varnum, Riddering, Wierengo & Christenson

[57] ABSTRACT

A crack (12) in a concrete, cement or masonry wall (10) is repaired by injecting a fluid, liquid latex (14) into the crack (12). The exposed surface of the crack (12) is covered with a liquid, impermeable barrier (20) and then the fluid, low-viscosity, liquid latex (14) is injected through the barrier (20) into the crack (12). The liquid latex (14) subsequently cures into a solid, elastomeric state. The latex (14) substantially fills the crack and allows shifting of the wall (10) due to temperature and pressure changes or settling of the wall (10) without damaging the cured latex (14) or causing any further growth of the crack (12).

20 Claims, 4 Drawing Figures

CONCRETE CRACK SEALING SYSTEM

BACKGROUND OF THE INVENTION

1. Technical Field

The invention relates to sealing cracks in cement, concrete and masonry.

2. Background Art

Concrete, cement and masonry walls often develop cracks due to settling of a building, which causes stressing of the wall. Propagation of the cracks is enhanced by leakage of water into the crack, such as often results in the basement of homes. It is a common practice to repair these cracks and holes in concrete, cement or masonry walls by filling the openings with a filler or sealant, such as caulk, which is initially in a fluid or plastic state and subsequently hardens when exposed to air. These prior art sealing systems often employ a sealant which is injected into a crack under a high pressure so that a sealing material is injected into the holes or cracks. For example, in the Alberts U.S. Pat. No. 4,086,309 issued Apr. 25, 1978, a method for sealing cracks or cavities is disclosed wherein ports are driven into a wall which is sealed outwardly and connected to a pressurized vacuum source. This vacuum source draws water present in the cracks out through the holes. A sealing material, such as cement, epoxy, tar or silicate-based sealants, is then drawn into the cracks where it is allowed to harden.

In the Simonson U.S. Pat. No. 3,224,346, issued Dec. 21, 1965, void or delaminated areas of terrazzo floors or concrete slabs are repaired with a liquid epoxy resin. Repair holes are drilled through the surface of the floor to the void spaces to provide for the attachment of fittings which complement a pressure-gun nozzle placed in the repair holes. The liquid epoxy resin bonding composition is pumped under high pressure into the voids through the repair hole until the composition flows into and out from the adjacent holes.

In the Watts U.S. Pat. No. 3,646,720, issued Mar. 7, 1972, cracks or joints which are below ground level in a concrete structure are sealed by a process wherein a strip of material is bonded over the crack to form a channel extending along the crack. Fittings are inserted in the strips and air is pumped into the channels to determine the amount of leakage. Subsequently, an epoxy sealer is prepared and pumped under pressure through the fittings into the channels to fill and seal the cracks. The known filler sealants are generally difficult and inconvenient to apply unless pressurized by the injection tools used to pump the sealant into the cracks.

Furthermore, several systems employ multicomposition sealant fillers for repairing concrete or masonry structures. These sealants need be admixed and then applied to the crack. In the Basile U.S. Pat. No. 3,917,771, issued Nov. 4, 1975, for example, the first compound is a paste-like material formed of a water-based acrylic latex or caulking material having a sand dispersion. The second compound is a paste-like material which includes Portland cement and bentonite in a polyhydric alcohol. The two compounds are separately packaged and are admixed and applied to a work area to form a plug within a crack.

The prior art sealing systems tend to use a sealant filler that possess characteristics substantially similar to that of concrete when hardened. These prior art sealant fillers will form a filler which cannot respond to further movement of the wall. When the wall does move, the sealant filler may crack or other cracks will be created due to the sealant's lack of flexibility or elasticity. Thus, crack propagation will not be eliminated. The prior art sealing systems do not repair cracks simply, inexpensively and conveniently and require the use of pressurized injection tools. The sealant compounds used in these systems are not injected so as to deeply penetrate into a crack. Finally, such sealant compounds do not have the flexibility needed to accommodate wall movement after the sealant has set within the crack.

DISCLOSURE OF THE INVENTION

In accordance with the invention, a crack in a cementatious, masonry or concrete structure is sealed by injecting a fluid, liquid latex composition into the crack. A liquid impermeable barrier is applied over the length of the crack to prevent the latex material from flowing out of the crack during injection. After the barrier has been applied to the crack surface, the fluid, liquid latex is injected through the barrier so that the latex substantially fills the crack, with the barrier preventing the latex from flowing out of the crack. The latex has a low viscosity which enables it to penetrate deeply into the crack and slightly into the structure adjacent thereto. After the latex has been injected, it cures into a solid, elastomeric state.

The latex composition is preferably injected under the influence of a relatively low pressure which may be supplied by a squeeze bottle or squeeze bag. Due to the low viscosity of the latex, only a small pressure is needed to cause the latex to flow into the crack. For long cracks, the latex composition may be injected at a plurality of locations spaced apart along the crack length. After the latex composition has been injected, the injection sites can be covered over with the barrier material or another sealant.

The latex composition is preferably an acrylonitrile butadiene copolymer in an aqueous medium. The acrylonitrile butadiene copolymer typically has a viscosity range of 35 to 140 cps, preferably about 85, and a solids content range between 35% and 75%, preferably about 50%. Since the latex is water soluble, its strength is not affected by the presence of water in the crack, which often occurs in basements of homes and the like. Thus, the latex composition provides an effective sealant for such cracks. The latex composition retains its strength and provides a desired resiliency to accomodate further shifting of the walls or growth of the crack.

The liquid impermeable barrier can be any composition or device which forms a temporary dam over the crack. Caulking compounds, nitrile rubber and tape are suitable examples. A nitrile rubber sealant sold under the trade name "PERMANENT ALUMINUM SEALER" by the Rusco Company of Cleveland, Oh. is a specific example of a barrier material.

In order to aid in injecting the latex into the crack, at least one tubular injection channel or porthole can be mounted along the length of the crack. The porthole receives an applicator or injector on the squeeze bottle or other type of applicator for depositing the latex into the crack. When a number of such injection channels or injection locations are used, such as on a long crack, the crack is filled by starting at the lowermost location and progressing to the uppermost.

In order to facilitate use of the crack sealing system, the components thereof may be sold in a kit form. The kit includes a liquid latex which is curable into an elastomeric state, an applicator for depositing the latex in the crack, and a liquid impermeable barrier such as a paint-like sealant or tape which prevents the latex from flowing out of the crack during injection. The kit is used to carry out the above-described process. The applicator, as described above, may comprise a squeeze bottle or bag which includes a nozzle or other injector-type apparatus for depositing the latex in the crack.

BRIEF DESCRIPTION OF THE DRAWINGS

The invention will now be described with reference to the accompanying drawings in which.

DETAILED DESCRIPTION OF THE PREFERRED EMBODIMENT

Figure 2:
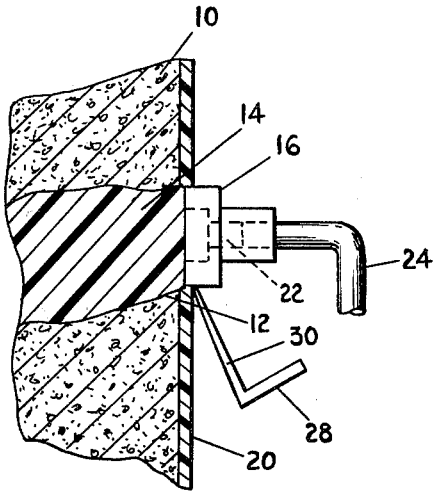
FIG. 2 is a side sectional view of a wall showing the injection of latex into a crack in the wall.
Figure 1:
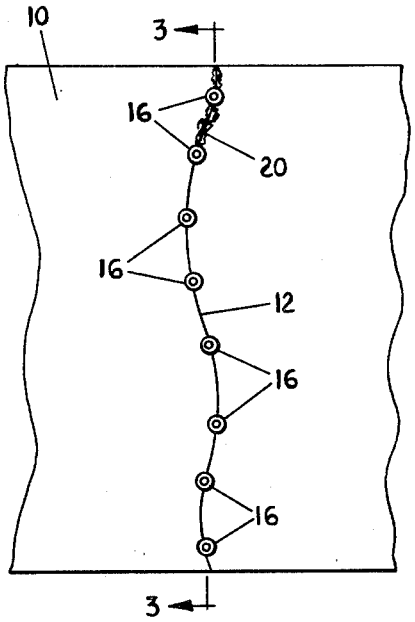
FIG. 1 is a front view of a wall including a crack schematically showing the sealing thereof in accordance with the invention.

Referring to FIGS. 1–4, a wall 10, such as a basement wall of a home or the like, includes a crack 12 which is formed therein due to settling of the house, erosion from water or the like. The wall 10 may be a cementatious, masonry or concrete structure. In order to deter crack propagation and inhibit the seepage of water into a basement of a home through the crack, it is desirable to seal the crack 12.

In accordance with the invention, a highly fluid, liquid latex 14 is injected into the crack 12 to seal the crack and prevent further crack growth. To facilitate injection of the liquid latex 14 into the crack 12, a plurality of injection portholes or channels 16 can be adhered to the wall surface. The portholes 16 provide a conduit for communicating an applicator 18, which holds the liquid latex 14, to the crack interior wherein the latex 14 is deposited. The portholes or channels 16 are typically employed to repair cracks of large length wherein it is desirable to inject the latex 14 at a number of locations along the crack 12 to ensure the filling of the entire crack. For cracks of smaller length, one such porthole 16 may be employed or the latex 14 may be injected directly into the crack 12. The portholes 16 are spaced apart a selected distance, for example, 6–12 inches, which is partially dependent upon the viscosity of the latex material 14. By placing the portholes 16 along the length of the crack 12 or otherwise providing sites for injection of the latex 16 into the crack interior, the crack 12 may be entirely filled by injecting the latex at a number of locations.

Figure 3:
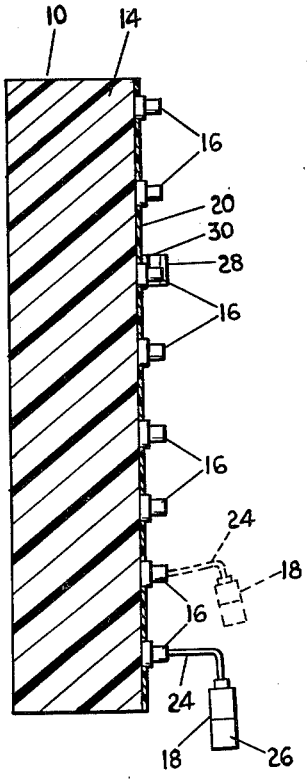
FIG. 3 is a cross-sectional view taken along the crack length along lines 3—3 of FIG. 1.
Figure 4:
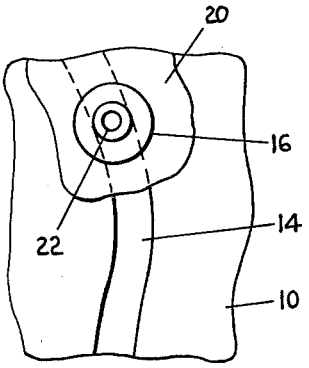
FIG. 4 is a detailed view of the crack showing the latex sealant, the liquid impermeable barrier and a porthole.

Since the latex is highly fluid, it is necessary to provide a barrier material 20 over the exposed portion of the crack to prevent the latex from flowing out of the crack when injected into the crack interior (see FIGS. 3 and 4). The barrier material 20 can comprise a liquid epoxy cement which is painted over the exposed crack surface. Other forms of barrier materials such as a fluid impervious tape-like material may be applied over the crack. The barrier material 20 is fluid impervious so as to prevent the outflow of the latex 14 from the crack interior. Other mechanical means which hold the fluid latex 14 in place until curing occurs can also be used.

The injection portholes 16 used to communicate an applicator 18 with the crack interior have a central bore 22 for channeling the liquid latex 14 from the applicator 18 to the crack interior. These portholes 16 are adhered to the area of the crack 12 with the central bore 22 positioned over the exposed portion of the crack 12. After the crack 12 is repaired, the portholes 16 can be removed and the injection site sealed over or otherwise covered.

The liquid latex 14 is injected into the crack 12 by means of an applicator 18 which provides a slight pressure so as to cause the latex 14 to flow from the applicator 18 through the porthole 16 and into the crack 12. A simple and convenient type of applicator 18 is a conventional squeeze bottle (see FIG. 3) provided with a nozzle 24 which fits into the bore 22 in the porthole. The squeeze bottle stores the liquid latex material in a reservoir 26 and the application of hand pressure to the bottle itself applies air pressure to the latex 14 and forces it through the nozzle 24 and into the crack 12. Other forms of applicators may be used, but it is only necessary to apply a slight pressure to commence liquid fluid flow from the applicator to the crack. This sealant material is in distinction to other forms of sealant material wherein it is necessary to apply a relatively high pressure to force the sealant into the crack.

The liquid latex 14 which is injected into the crack 12 by means of the applicator 18 can be an acrylonitrile butadiene copolymer having a 47% solids content diluted in water. The viscosity range of the latex is preferably 35 to 140 cps. The latex provides a material having good flowability which allows the latex to entirely penetrate the crack through capillary action, or otherwise, and provide an effective seal yet maintain a desired elasticity and flexibility. One such latex which can be used is sold under the trade name HAYCAR 1572X45, manufactured by B. F. Goodrich of Cleveland, OH. Other types of compounds which can be used are acrylic and butadiene styrene copolymers. The use of a water soluble compound is important in that a frequent use of such sealant materials is in basements wherein the cracks are exposed to water. The use of conventional sealant materials which are cement-based would not be effective in such environments since the strength of the cementatious sealant is weakened by water. In distinction, a water soluble compound would not be weakened in such a manner.

The elasticity possessed by this type of sealant, when in a cured state, also allows for further shifting and levelling of the wall without further crack growth. In this regard, the resiliency afforded by the latex sealant allows movement of the walls of the crack relative to each other in distinction to a rigid sealant material wherein movement of the walls against a rigid sealant would cause further growth of the crack.

When a crack 12 in a wall 10 is to be sealed, the latex material 14, which is in liquid form, is placed in the applicator 18 such as the squeeze bottle. The applicator 18 is fitted with an injection nozzle 24 or other means for depositing the latex 14 within the crack 12. The crack 12 is prepared by adhering the portholes 16 over the crack 12 if a large crack is present and then covering the exposed portion of the crack with a fluid impervious barrier material 20 such as discussed above. One form of such material 20 may be a viscous caulking which is spread over the crack. For small cracks, substantially the entire length of the exposed portion of the crack 12 is covered, leaving a small access area for injecting the latex 14 into the crack interior. Once the crack site has been prepared, the latex 14 is injected into the crack 12 by means of the applicator 18. The applicator 18, such as the squeeze bottle, provides a practical method of injecting latex 14 in that it applies a slight pressure which causes the highly flowable latex to flow from the applicator and into the crack interior.

The flowability of the latex causes the material to substantially fill the entire interior of the crack 12 and penetrate the entire depth thereof. The low viscosity of the latex allows it to flow by capillary action to even the very small portions of the crack. Further, due to the water base and density of the latex material, it is able to penetrate the sides of the crack and displace water which is present in many subterranean walls.

Where a number of injection sites are used, the crack 12 is filled from the bottom up, starting with the lowermost porthole and progressing to the uppermost (see FIG. 3). After the interior area of the crack 12 has been filled with the latex 14, curing takes place until the latex 14 cures into resilient, flexible compound. The curing generally takes place over a 24 to 48 hour period.

After the latex is cured, the portholes 16, if they are used, may be removed and the areas covered over with a sealant or barrier-type material. Alternatively, the central bores 22 in the portholes 16 may be sealed over by a plug 28 as shown in FIG. 2. The plug 28 may be formed integral with the portholes, as shown, and separated therefrom by a web 30.

The above-described crack sealing system provides a convenient method of filling cracks which are exposed to water. In this regard, the use of a flowable latex material which is water soluble allows the sealant to penetrate to all portions of the crack and retain its strength in the presence of water. Additionally, the latex is injected under a very low pressure and with no need for preparing the interior of the crack prior to injection. The resultant sealant, which cures to an elastomeric state, allows for further movement and shifting of the walls due to water pressure or settling of the structure, for example, without causing further crack growth or having a deleterious effect on the sealant compound itself. The latex can be used with a variety of construction materials such as cement, concrete and masonry and has an especially good application in walls which are exposed to water. The ability of the latex to flow into narrow spaces and the flowability which allows the material to penetrate fully within the crack effectively seals the entire crack and prevents further crack growth or seepage of water into a basement or other structure.

The materials used in the crack sealing system may be sold in a kit form which includes the latex, an applicator such as a squeeze bottle or bag and a liquid impermeable barrier such as a liquid sealant which is painted over the exposed crack. Additionally, the injection channels and portholes described above can be included in the kit to facilitate repair of large cracks. Each of the components of the kit is described above, with the latex being packaged so as to retain its liquid state prior to injection into the crack. Although the process described above uses a squeeze bottle as the applicator for depositing the latex in the crack, other forms of applicators may be used so long as the applicator can apply a slight pressure to the liquid latex to cause it to flow into the crack. It is contemplated that the components of the kit are reusable and that is it only necessary to purchase additional latex materials or other sealants and other barrier-type materials as needed.

The foregoing and description of drawings are merely illustrative of the invention and are not intended to limit the invention to the above-described embodiments. Variations and changes which may be obvious to one skilled in the art may be made without departing from the scope and spirit of the invention as defined in the appended claims.

The embodiments of the invention in which an exclusive property or privilege is claimed are defined as follows:

1. A method for sealing cracks in cementatious, concrete or masonry structures comprising the steps of:

applying a liquid-impermeable barrier material to a structure containing a crack over substantially the entire length of the exposed portion of the crack;

injecting a fluid, liquid latex composition through said liquid impermeable barrier into said crack at at leastone location behind the barrier so that said latex substantially fills the crack, said barrier preventing the latex from flowing out of the crack;

said fluid liquid latex composition having a low viscosity so as to penetrate into the crack interior and curable into a solid, elastomeric state; and, curing said latex composition in place into a solid, elastomeric state.

2. The method of claim 1 wherein said liquid latex composition is injected into said crack under the influence of a relatively low pressure.

3. The method of claim 1 and further comprising the step of injecting said latex composition at a plurality of spaced locations along the length of the crack, progressing from the lowermost location to the uppermost.

4. The method of claim 3 and further comprising the step of covering said injection locations subsequent to injecting said latex composition into said crack.

5. The method of claim 1 wherein said latex composition comprises an acrylonitrile butadiene copolymer.

6. The method of claim 1 and further comprising the step of mounting at least one injection channel over said crack so as to communicate said liquid latex composition to the crack interior.

7. The method of claim 6 wherein the liquid latex composition is injected through said at least one injection channel into said crack under the influence of a relatively low pressure.

8. The method of claim 7 wherein the liquid latex composition comprises an acrylonitrile butadiene copolymer.

9. The method of claim 8 wherein said copolymer has a 35% to 75% solids content and a viscosity range of 35 to 140 cps.

10. The method of claim 6 wherein a plurality of injection channels are mounted over said crack.

11. The method of claim 10 wherein said plurality of injection channels are spaced at predetermined intervals along the length of said crack and the step of injecting said fluid liquid latex composition commences at the lowermost injection channel and progresses to the uppermost.

12. The method of claim 11 further comprising the step of covering said injection channels subsequent to the injection of said fluid, liquid latex composition into the interior of said crack.

13. A kit for sealing cracks in cementatious, concrete and masonry structures comprising:

a fluid, liquid latex composition which is deposited in a crack, said latex being curable at ordinary temperatures and pressures into a solid, elastomeric state and having a low viscosity so as to enable said latex to penetrate deeply into said crack;

applicator means for injecting said latex composition in said crack; and liquid-impermeable barrier means for application to an exposed surface of said crack for preventing said latex composition from flowing out of said crack during injection;

wherein said kit can be used to repair cracks by injecting the latex composition into said crack by use of said applicator means after applying said barrier means to the exposed crack surface to prevent said latex composition from flowing out of the crack.

14. The kit of claim 13 wherein said applicator means includes an injection nozzle for directing the flow of the latex composition into said crack.

15. The kit of claim 14 wherein said applicator means is a squeeze bottle.

16. The kit of claim 13 wherein said barrier means is a coating applied to said exposed structure containing said crack.

17. The kit of claim 13 further including at least one tubular body adapted to be mounted over the exposed portion of the crack so as to provide a port and injection channel for the depositing of the latex composition into said crack.

18. The kit of claim 17 wherein said kit includes a plurality of said tubular bodies adapted to be mounted along the length of the crack at selected intervals.

19. The kit of claim 13 wherein said latex composition comprises an acrylontrile butadiene copolymer.

20. The kit of claim 19 wherein said latex composition has a viscosity range of 35 to 140 cps and a solids content of 35% to 75%.

* * * * *